US011175009B1

(12) United States Patent
Ho

(10) Patent No.: US 11,175,009 B1
(45) Date of Patent: Nov. 16, 2021

(54) PORTABLE INDICATION SYSTEM

(71) Applicant: Morr Global Co., Ltd., Taipei (TW)

(72) Inventor: Hung-hsin Ho, Taipei (TW)

(73) Assignee: Morr Global Co., Ltd., Taipei (TW)

( * ) Notice: Subject to any disclaimer, the term of this patent is extended or adjusted under 35 U.S.C. 154(b) by 0 days.

(21) Appl. No.: 17/244,918

(22) Filed: Apr. 29, 2021

(51) Int. Cl.

| | |
|---|---|
| ***F21S 43/50*** | (2018.01) |
| ***F21V 23/00*** | (2015.01) |
| ***F21V 23/04*** | (2006.01) |
| ***F21V 21/096*** | (2006.01) |
| ***F21V 21/088*** | (2006.01) |
| ***F21V 21/14*** | (2006.01) |
| *F21W 103/00* | (2018.01) |

(52) U.S. Cl.
CPC ..... *F21S 43/50* (2018.01); *F21V 21/088* (2013.01); *F21V 21/096* (2013.01); *F21V 21/14* (2013.01); *F21V 23/003* (2013.01); *F21V 23/045* (2013.01); *F21W 2103/00* (2018.01)

(58) Field of Classification Search
CPC ..... F21S 43/50; F21V 23/045; F21V 23/003; F21V 21/088; F21V 21/096; F21V 21/14; F21W 2103/00
See application file for complete search history.

(56) References Cited

U.S. PATENT DOCUMENTS 6,150,950 A * 11/2000 Shen Liu ..... A44C 15/0015 340/321
7,221,263 B2 * 5/2007 Moore ..... B60Q 1/2676 340/427
7,455,139 B2 * 11/2008 Lee ..... B60Q 1/2673 180/167
9,457,709 B2 * 10/2016 Alataas ..... B60Q 1/38
10,086,894 B2 * 10/2018 Arkhangelskiy .... B60Q 1/0023
10,315,559 B2 * 6/2019 Hammock ..... B62J 6/04
10,711,987 B1 * 7/2020 Ho ..... B60Q 1/44
2008/0088423 A1 * 4/2008 Liu ..... B62J 6/04 340/432
2011/0267806 A1 * 11/2011 Chen ..... F21V 33/0004 362/157
2014/0043151 A1 * 2/2014 Lin ..... B62J 6/05 340/432
2014/0043794 A1 * 2/2014 Carriere ..... F21V 33/0008 362/103

* cited by examiner

*Primary Examiner* — Zheng Song

(57) ABSTRACT

The present invention relates to a portable indication system, including an indication device and a control device. The indication device has a cover, a printed circuit board, and an indicator. The control device has an operation interface, a wireless transmission module, and a micro-processor. The indicator has a light transmissive member detachable with the cover and a light emitting member that is assembled inside the light transmissive member. A length of the light emitting member penetrates into the interior of the cover to form a connection portion electrically connected with the printed circuit board, and the rest of length of the light emitting member is located outside the cover to form a projection portion coved by the light transmissive member. This invention is designed with a fast-detached mechanism facilitating users to replace the destructed light emitting member or modify the light emitting member by themselves according to their need.

11 Claims, 16 Drawing Sheets

1

PORTABLE INDICATION SYSTEM

FIELD OF THE INVENTION

The present invention relates to an indication system connected to each other through a wireless communication module, and in particular to a portable indication system that facilitates users to change a light source indicator by themselves.

BACKGROUND OF THE INVENTION

Most traffic accidents are caused by inadvertent negligence or bad driving habits of drivers or riders, or they are caused by the dead end of the driving or cycling vision. In addition, weather conditions that cause poor vision are also a cause of traffic accidents. In order to reduce the possibility of traffic accidents, in addition to the improvement of driving habits, additional warning or indication systems on vehicles or riders may also reduce the possibility of traffic accidents.

And with the rise of sports, cycling has become a common fitness activity for modern people. Most of the general sportsmen will add front and rear warning lights on their bicycles, but when the bicycle is about to turn or brake, the sportsmen often have to turn back or wave to remind rear drivers or riders, which often causes the sportsmen to be distracted and leads to a high risk of traffic accidents.

Therefore, there are now additional wirelessly controlled warning lights or directional lights on helmets, rain jackets or backpacks on the market, allowing cyclists or sportsmen to alert the car behind them when turning or braking. However, the warning lights or directional lights used by most bicycles and motorcycles in the market are mostly of the one-piece design where the lights cannot be replaced. Therefore, when the lamps are used for a long time or accidentally damaged, the users often discard the lamps because they cannot replace the damaged lamps by themselves, it is not easy to repair them, or the maintenance amount is a consideration, so there is still room for improvement and innovation for this type of riding indicator.

SUMMARY OF THE INVENTION

The main purpose of this invention is to provide a small and portable indicator system and to design the light indicator of the indication system as a quick release mechanism, so users may quickly replace damaged light emitting members, or modify the light emitting members by themselves according to their needs.

A secondary purpose of the present invention is that the indication device which generates the light can be positioned in a variety of ways so that the user may mount the indication device on objects of various shapes.

To achieve the foregoing, the portable indication system of the present invention comprises an indication device and a control device that is wirelessly connected to the indication device. The indication device has a cover and an indicator that is removably attached to the cover. The cover is constructed with an interior and an orifice connecting the interior, and a printed circuit board is provided in the interior. The printed circuit board has a wireless receiver module and a connector at the extension of the orifice.

The control device is constructed with an operation interface, a wireless transmission module, and a micro-processor. The wireless transmission module is connected to the wireless receiver module. The micro-processor is electrically connected to the operation interface and the wireless transmission module. A control command can be generated by the operation interface, and the control command is transmitted from the micro-processor to the printed circuit board via the wireless transmission module and the wireless receiver module, so the indicator generates a projected light source in response to the control command.

In addition, the indicator has a light transmissive member and a light emitting member that is assembled inside the light transmissive member. A portion of the length of the light emitting member penetrates into the interior to form a connection portion with the connector electrically, and a remaining length of the light emitting member forms a projection portion outside the cover that is covered by the light transmissive member.

And the cover is composed of a first shell member and a second shell member that is removably mounted to the first shell member. After the first shell member is removed from the second shell member, one edge of the orifice will form a hollow section to allow the indicator to be separated from the cover.

Further, the light transmissive member has a detachable portion and a wrapping portion. The detachable portion is fixed around the orifice inside the cover and a slot is formed inside both the detachable portion and the wrapping portion. The light emitting member may be inserted into the detachable portion and the wrapping portion in sequence so that the projection portion can be covered by the wrapping portion completely.

The detachable portion is constructed with a baffle and a retainer located on opposite sides of the orifice. A neck that fits the shape of the orifice is provided between the baffle and the retainer. Thus, the detachable portion that is confined by the orifice cannot move with respect to cover.

The light transmissive member and the light emitting member are composed of a flexible material. The indicator may match in a changed shape with an object of a shape.

In a possible embodiment, the indication device further has a positioning belt. The positioning belt has several opening holes. The light transmissive member has a positioning portion that extends from the wrapping portion. The positioning portion is provided with a positioning pillar that may be inserted into one of the openings. Thus, the positioning belt, the cover and the indicator form together an accommodation space as a first positioning means. The locating pillar is composed of a magnetic material, so the light transmissive member can generate a magnetic suction as a secondary locating means.

In another possible embodiment, the indication device further comprises an oscillating bracket. The oscillating bracket is equipped with an oscillating part and a positioning portion. The oscillating part has a wedge track, a shaft, and a baffle connected between the wedge track and the shaft. The positioning portion has two hubs pivotally connected to the shaft and a contact plate fixed to an object.

In a further possible embodiment, the indication device further comprises a clamping bracket. The clamping bracket has a wedge track, a clamping arm, and a partition connected between the wedge track and the clamping arm. The wedge track is assembled in a positioning groove formed by the cover. A first end of the clamping arm is connected to the partition. And a second end of the clamping arm touches the partition. The second end of the clamping arm will generate a resilient recovery force when moving away from the partition.

The control device is provided with a housing for accommodating the operation interface, the wireless transmission module, and the micro-processor, and a fixed belt that together with the housing forms an enclosing space. The housing has a top cover forming an orifice and a bottom cover forming a depression, and the bottom cover is provided with at least one snap hook on the two opposite sides of the cover separately. The fixed belt is connected to the snap hook at each end of the belt. Further, a central section of the fixed belt may hold an object in conjunction with the depression.

In summary, in this invention, a removable mechanism between the indicator and the cover is applied. The quick release socket and connector between the indicator and the printed circuit board allow the users to independently and quickly remove the indicator from the cover for easy maintenance or to replace the light source according to personal preference, and thus the practicality of the indication system is greatly enhanced. In addition, the back side of the cover may be installed in a variety of different styles of brackets so that the indication system can be applied to helmets, raincoats, backpacks, jackets and other different pieces.

DETAILED DESCRIPTION OF THE PREFERRED EMBODIMENTS

Hereinafter, preferred embodiments of the present invention are cited, and further detailed description is given as follows in conjunction with the drawings.

Figure 1:
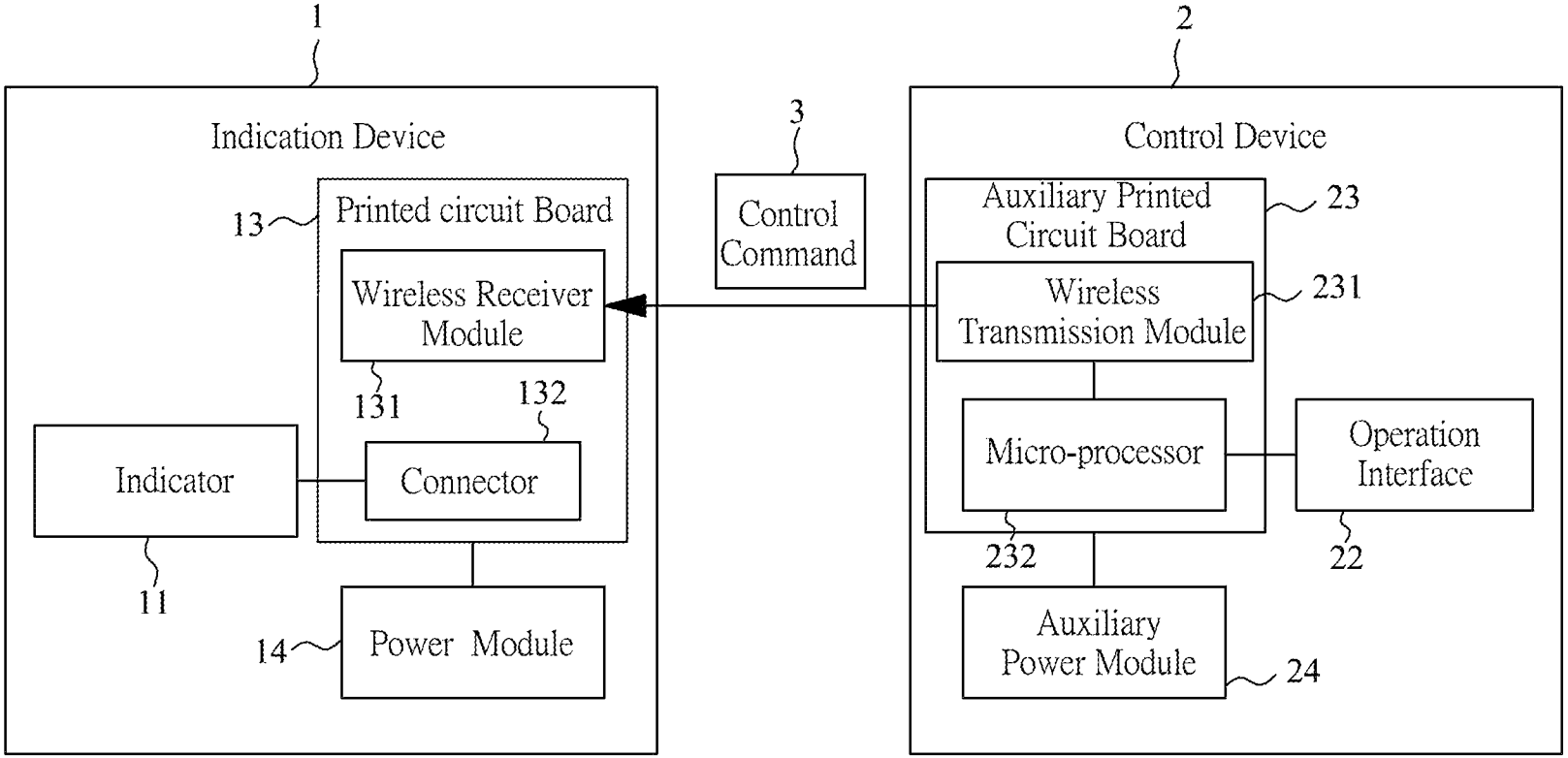
FIG. 1 is a block diagram of a portable indication system according to this invention.
Figure 2:
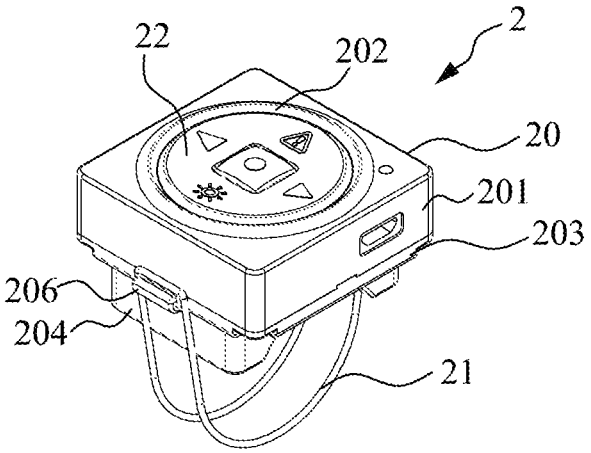
FIG. 2 is a three-dimensional view of the portable indication system according to this invention.
Figure 2:
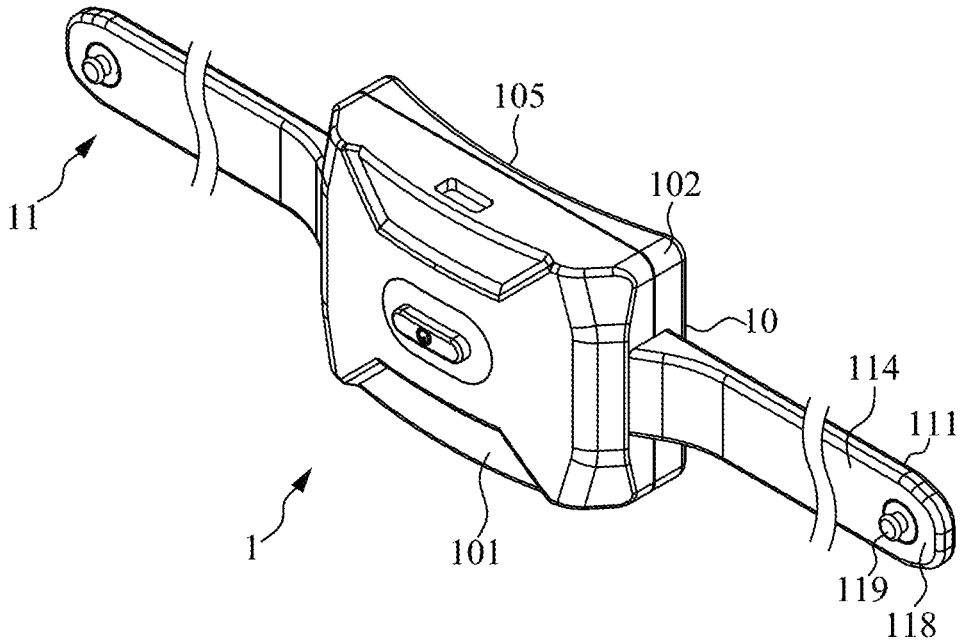

Referring to FIG. 1 and FIG. 2, a portable indication system according to this invention mainly comprises an indication device 1 which may be mounted on various shaped objects and a control device 2 which may be held by one hand. And the control device 2 activates the indication device 1 through a wireless connection and may control the indication device 1 for light display mode.

Figure 3:
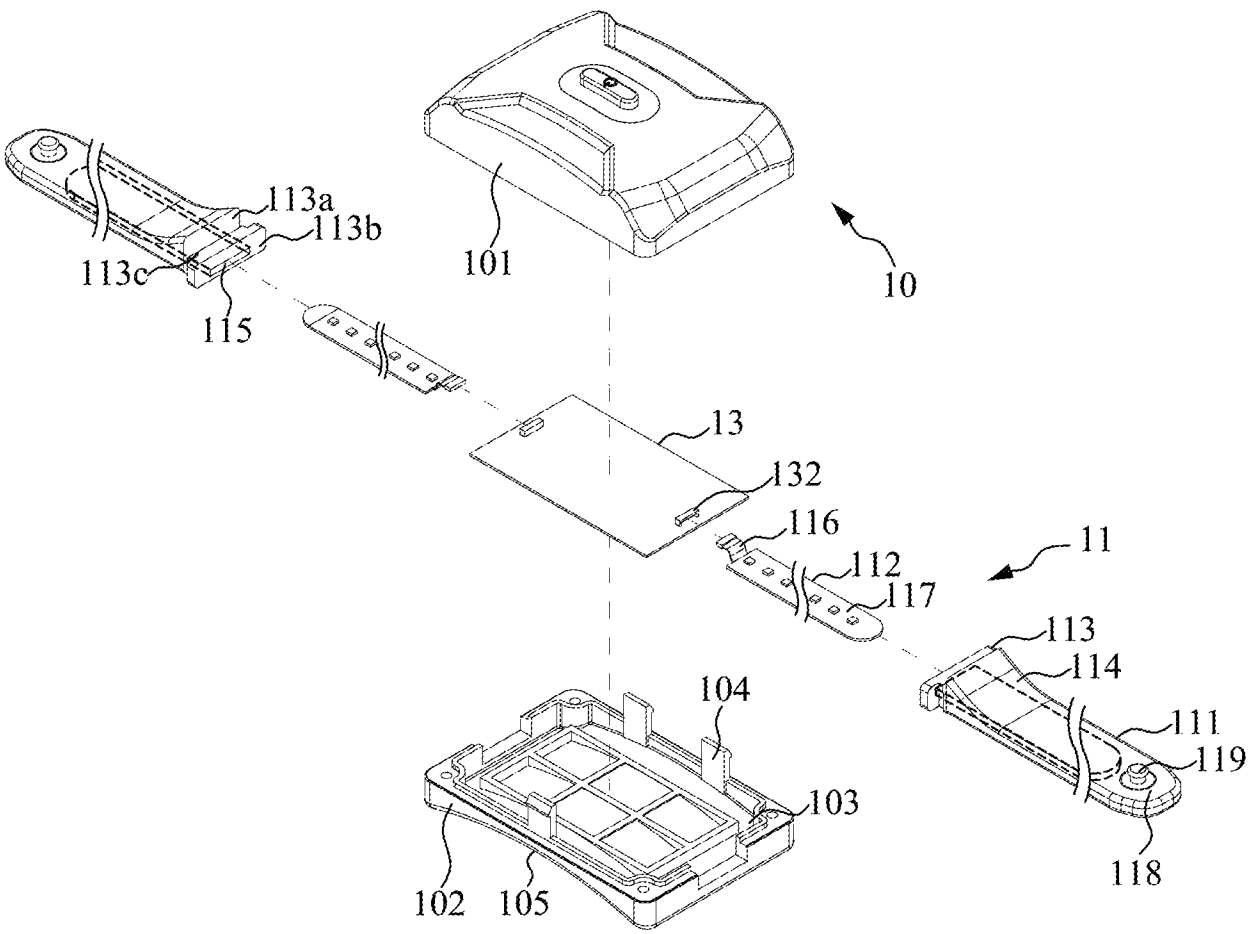
FIG. 3 is an exploded view of the indication device of FIG. 2.
Figure 4:
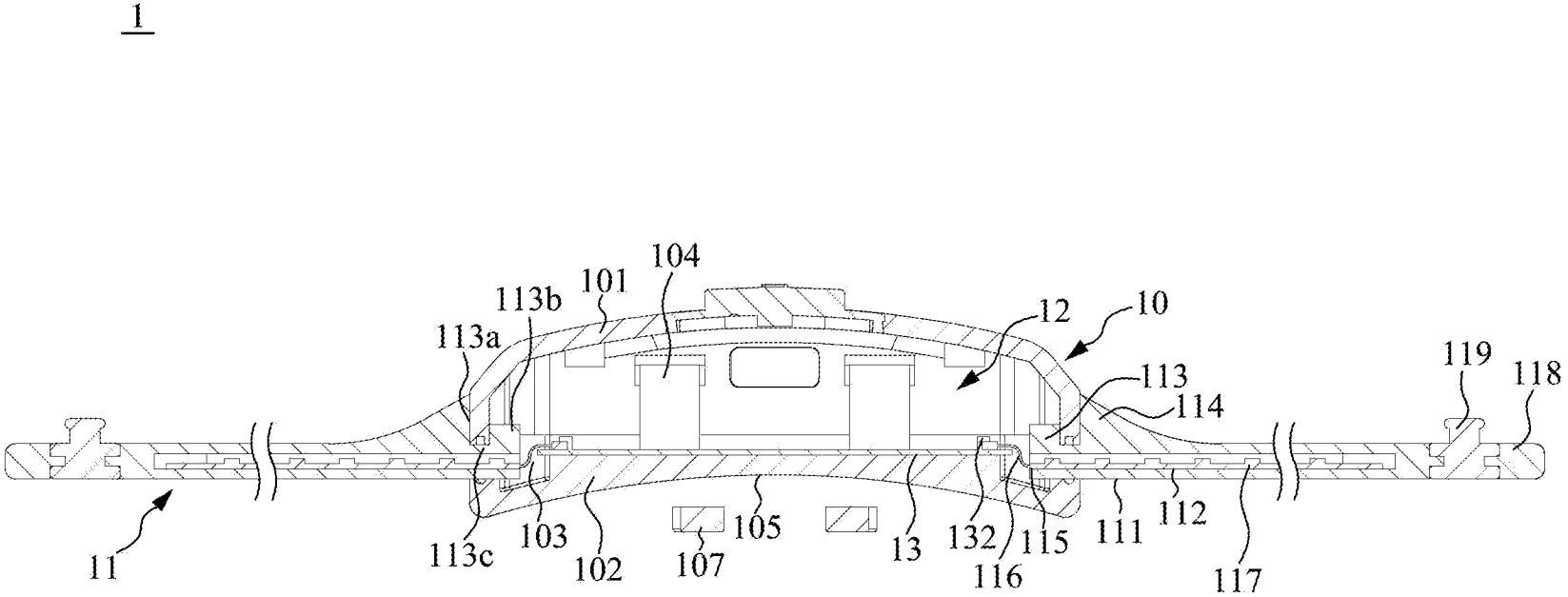
FIG. 4 shows the cross-section of the indication device of FIG. 2.

Referring to FIG. 1, FIG. 3 and FIG. 4, the indication device 1 has a cover 10 and two indicators 11 that may be disassembled on the side of the cover 10. The cover 10 is formed by an upper shell part 101 and a lower shell part 102 together to form an interior 12. And the cover 10 on each side of the formation of an orifice connected to the interior (not shown). As shown in the figure, the lower shell part 102 is constructed with a groove 103 on both opposite sides to form a hollow section. When the upper shell part 101 is connected to the lower shell part 102, the groove 103 will be blocked by the upper shell part 101 and will be closed into the orifice; contrarily, when the upper shell part 101 is separated from the lower shell part 102, the indicator 11 will be able to disengage the lower shell part 102 through the groove 103 of the hollow section.

The interior 12 is provided with a printed circuit board 13 secured to the lower shell part 102 and a power module 14 secured to the printed circuit board 13. The printed circuit board 13 has a wireless receiver module 131 and two quick-release connectors 132. The two connectors 132 are located on each side of the printed circuit board 13 and are aligned with an extension of the orifice. The power supply module 14 has a plug not shown that may be externally charged by an external power source and is electrically connected to the printed circuit board 13 to provide the power required by the indicator 11 and the wireless receiver module 131.

The upper shell part 101 and the lower shell part 102 are provided with a clamping mechanism. As shown in the figure, the wedge mechanism comprises a wedge hole (not shown) in the wall of the upper shell part 101 and a flexible snap hook 104 in the bottom plate of the lower shell part 102. When the upper shell part 101 and the lower shell part 102 are installed close to each other, the flexible snap hook 104 will be deformed by the wall action. Later, when the flexible snap hook 104 is moved to the wedge hole, the flexible snap hook 104 will be repositioned to fix in the wedge hole so that the upper shell part 101 and the lower shell part 102 are assembled with each other.

When the user wants to separate the upper shell part 101 and the lower shell part 102, the user only needs to apply force to the flexible snap hook 104 so that the elastic snap hook 104 deforms to contact the wall of the upper shell part 101, and then the upper shell part 101 and the lower shell part 102 may be separated from each other.

In order to facilitate the use of the indication device 2 in various situations, the indication device 2 is to be able to be mounted on various shapes of objects. Thus, the lower shell part 102 forms a curved outer surface 105, and the curved outer surface 105 is formed with a mounting groove 106, and the mounting groove 106 is used to install various different structural patterns of the bracket. As shown in the figure, the mounting groove 106 is molded between the curved outer surface 105 and a guiding member 107 extending from the curved outer surface 105.

Figure 5:
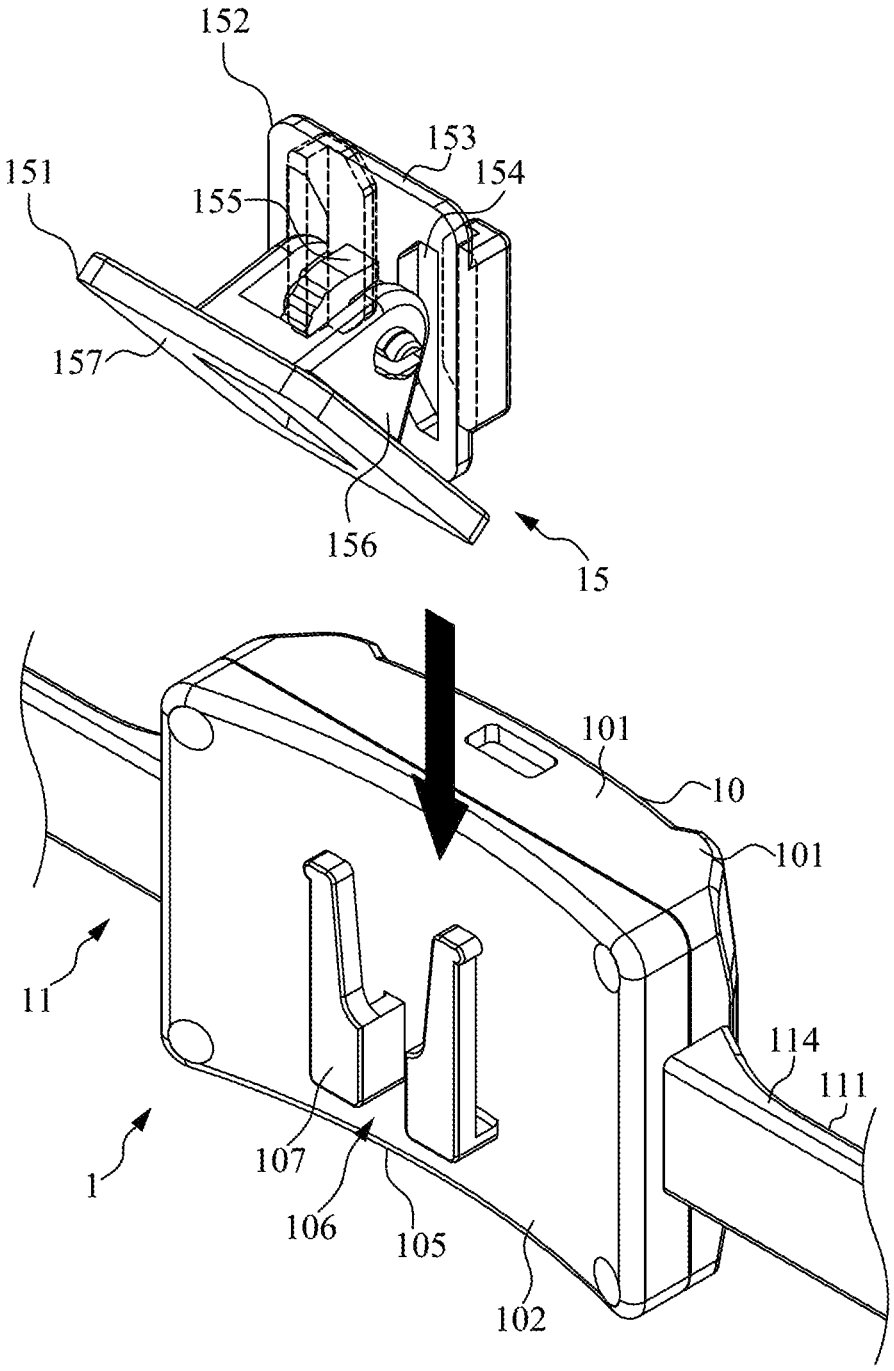
FIG. 5 is a schematic diagram of the oscillating bracket installed in the indication device of FIG. 2.

Referring to FIG. 5, the indication device 1 may comprise an oscillating bracket 15 that may be mounted with the lower shell part 102. The oscillating bracket 15 has a positioning portion 151 and an oscillating part 152 that may oscillate against the positioning portion 151. The oscillating part 152 has a baffle 153, a wedge track 154, and a shaft 155. The baffle 153 is connected to the wedge track 154 by a first surface and to the shaft 155 by a second surface on the opposite side of the first surface. The wedge track 154 is installed in the mounting groove 106 along the alignment. The positioning portion 151 has two hubs 156 pivotally connected to the shaft 155 and a contact plate 157 connecting the two hubs 156. The contact plate 157 may be provided with an adhesive layer (not shown in the figure) on one of the outer surfaces of the contact plate 157 to fit a bonded object (e.g., FIG. 12B).

Figure 6:
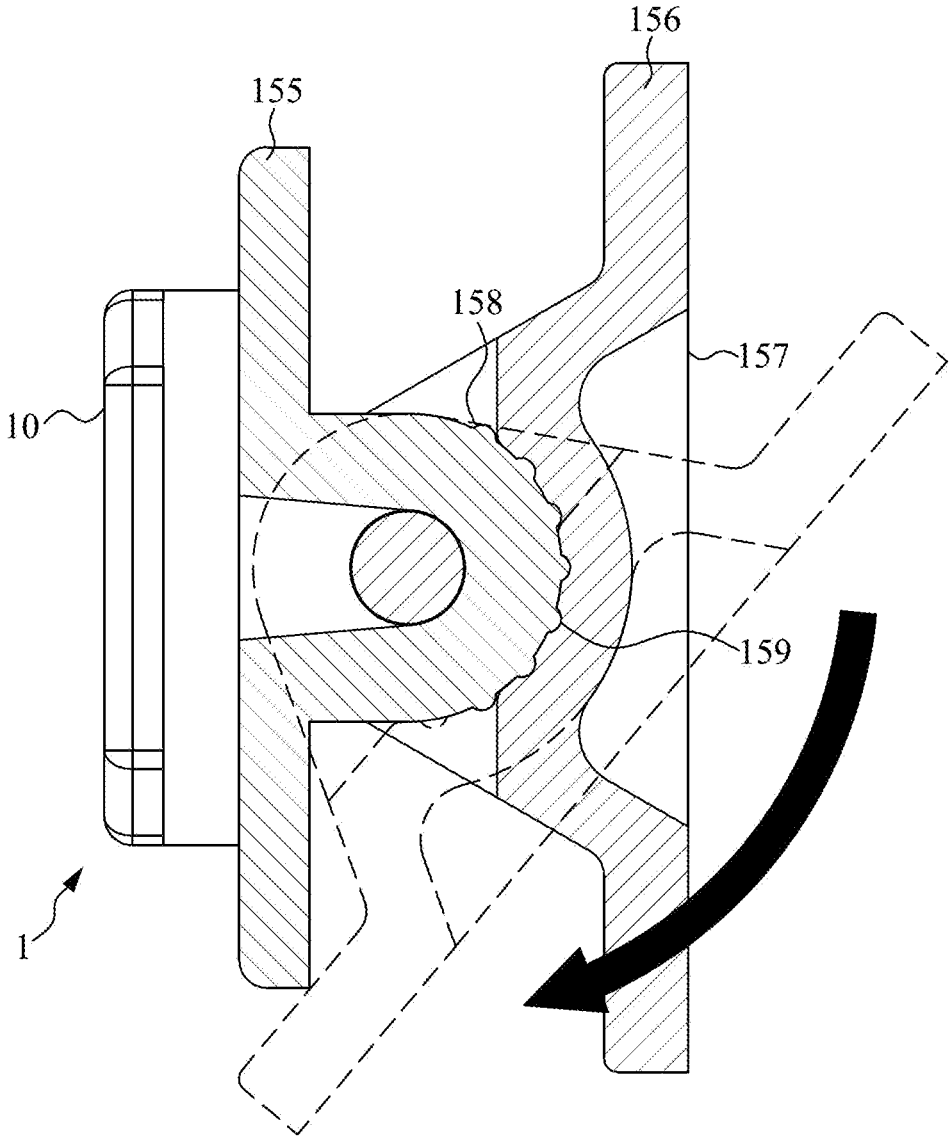
FIG. 6 shows the cross-section of the oscillating bracket of FIG. 5.

As shown in FIG. 6, the surface of the shaft 155 is formed with several spaced ribs 158. The surface of the hub 156 is formed with a plurality of spaced-apart depressions 159 so that the ribs 158 and the depressions 159 can together form a multi-stage positioning swing means.

Figure 7:
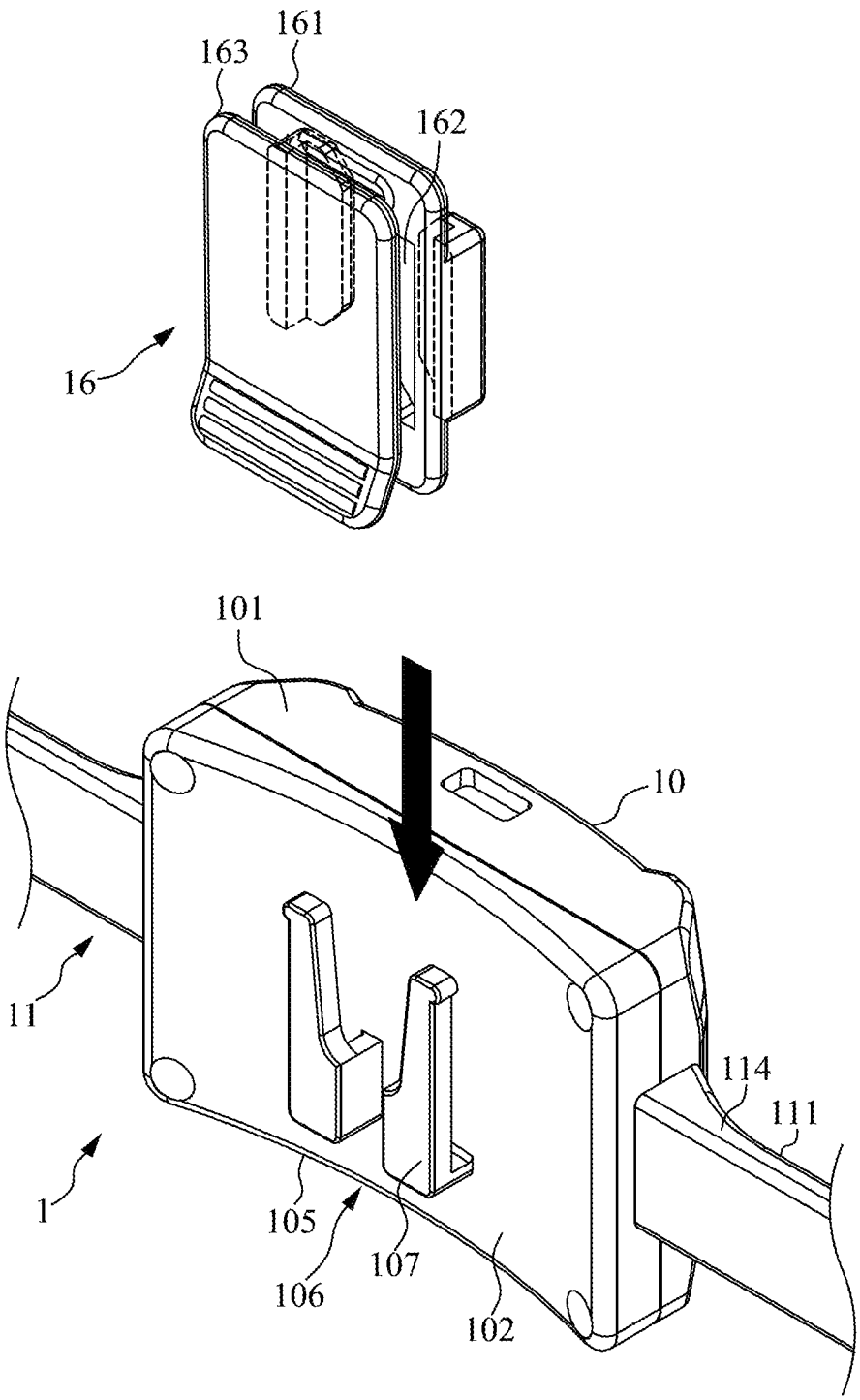
FIG. 7 is a schematic diagram of a clamping bracket mounted on the indication device of FIG. 2.

Referring to FIG. 7, in another possible embodiment, the indication device 2 may also comprise a clamping bracket 16. The clamping bracket 16 has a partition 161, a wedge track 162, and a clamping arm 163. The two opposite surfaces of the partition 161 are connected to the wedge track 162 and the clamping arm 163, respectively. A first end of the clamping arm 163 is connected to the partition 161, and a second end of the clamping arm 163 contacts the partition 161. An elastic restoring force is generated when the second end of the clamping arm 163 is moved away from the partition 161.

In addition, referring to FIG. 3 and FIG. 4, the indicator 11 comprises an elongated light transmissive member 111 and a light emitting member 112 assembled inside the light transmissive member 111. The light transmissive member 111 and the light emitting member 112 are constructed of a flexible material that allows the indicator 11 to produce a deformation to match the shape of an object.

Further, the light transmissive member 111 has a detachable portion 113 and a wrapping portion 114. The detachable portion 113 is fixed around the orifice inside the cover 10 so that the indicator 11 can be interconnected with the cover 10. The detachable portion 113 and the wrapping portion 114 together form a slot 115 so that the light emitting member 112 can be inserted into the detachable portion 113 and the wrapping portion 114.

As shown in the figure, a portion of the length of the light emitting member 112 penetrates into the interior 12 to form a connection portion 116 electrically connected to the connector 132. And a residual length of the light emitting member 112 forms a projection portion 117 wrapped by the light transmissive member 111 on the outside of the cover 10. The light emitting member 112 may be LED lights connected in series or an LED screen so that the light emitting member 112 is used as a font output.

The detachable portion 113 is constructed with a baffle 113*a* and a retainer 113*b* located on opposite sides of the orifice. The baffle 113*a* and the retainer 113*b* are provided with a neck 113*c* that fits the shape of the orifice so that the detachable portion 113 cannot be moved against the cover 10 by the orifice.

Figure 8:
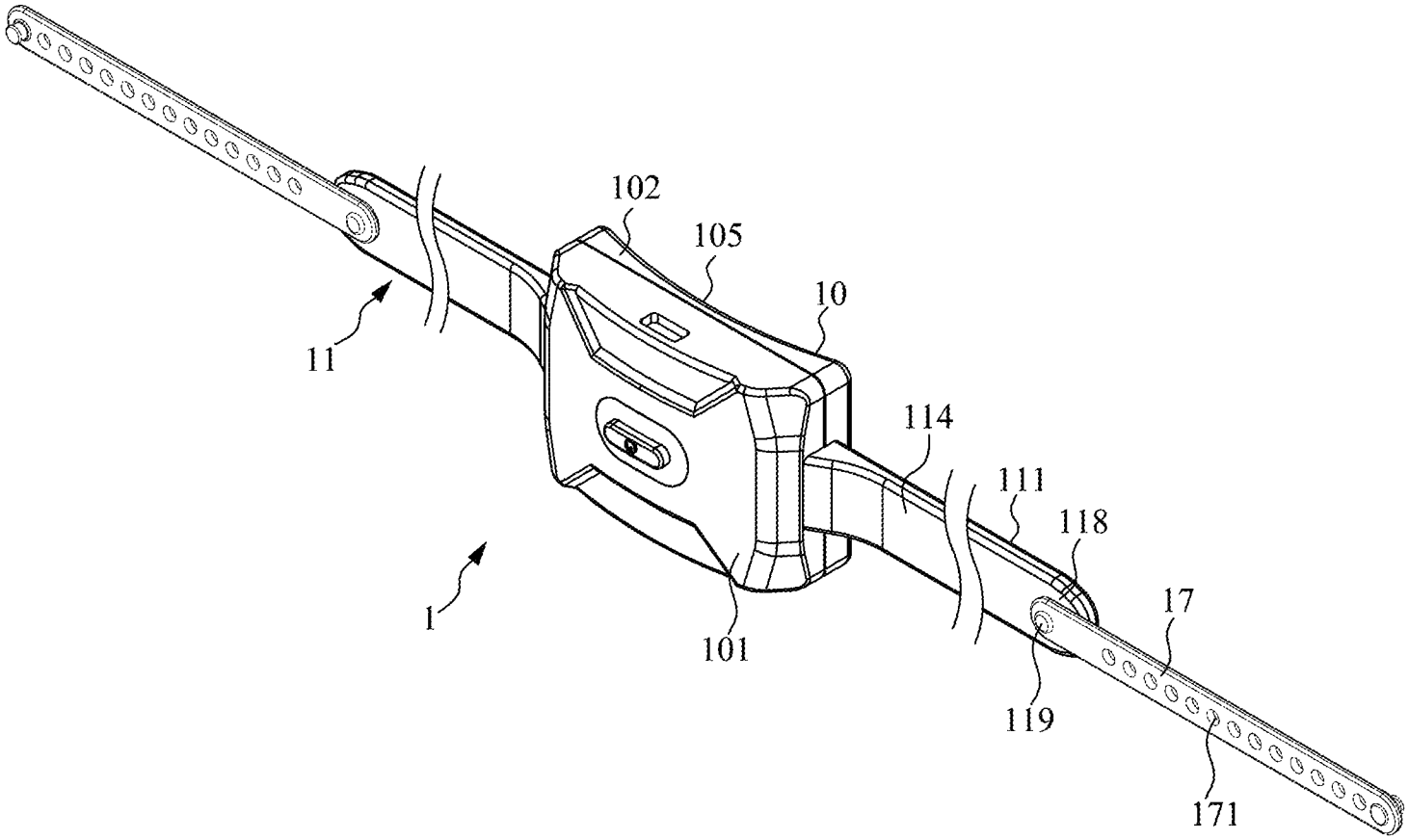
FIG. 8 is a schematic diagram of the positioning belt connected to the indication device of FIG. 2.
Figure 12A:
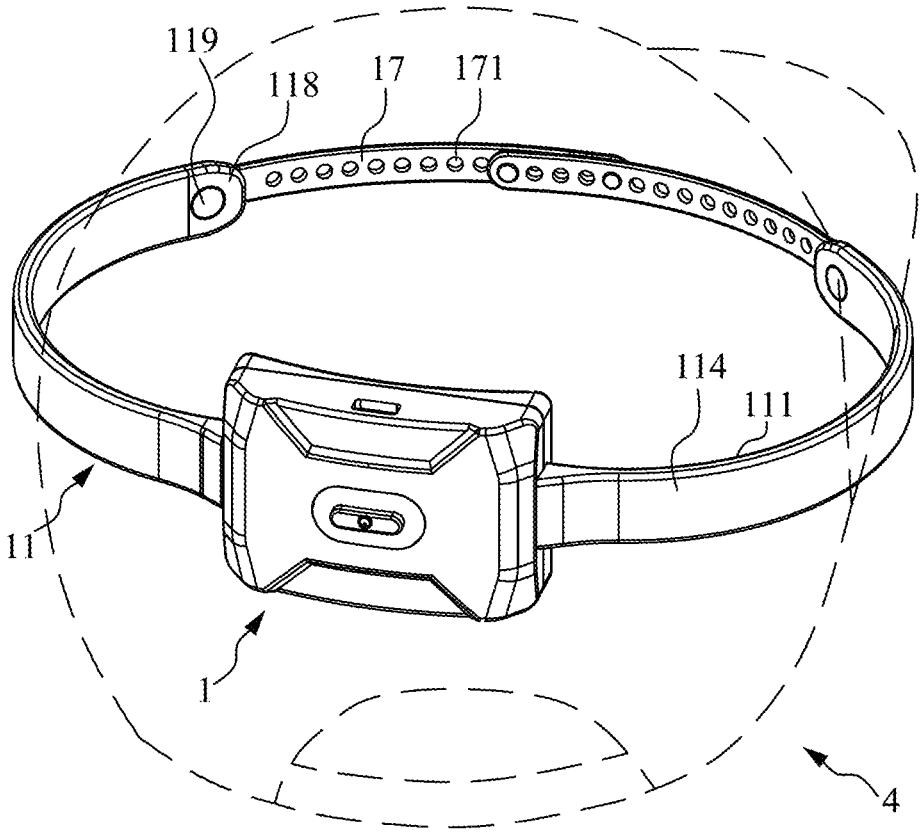
FIGS. 12A to 12C are schematic diagrams of this invention installed in various objects.

Referring to FIG. 8, the light transmissive member 111 has a positioning portion 118 that extends from the wrapping portion 114. The positioning portion 118 has a locating pillar 119. The locating pillar 119 can be used with a positioning belt 17 having a plurality of openings 171 so that the positioning belt 17, the housing 10, and the two indicators 11 together form a ring (as shown in FIG. 12*a*). The center of the ring forms a nesting space where the object may be nested, thereby forming a first positioning means by means of the positioning belt 17. Further, the locating pillar 119 may be composed of a magnetic material or an iron-containing material so that the light transmissive member 111 and another iron or magnetic clasp are made to produce a mutual suction as a second positioning means.

Figure 9:
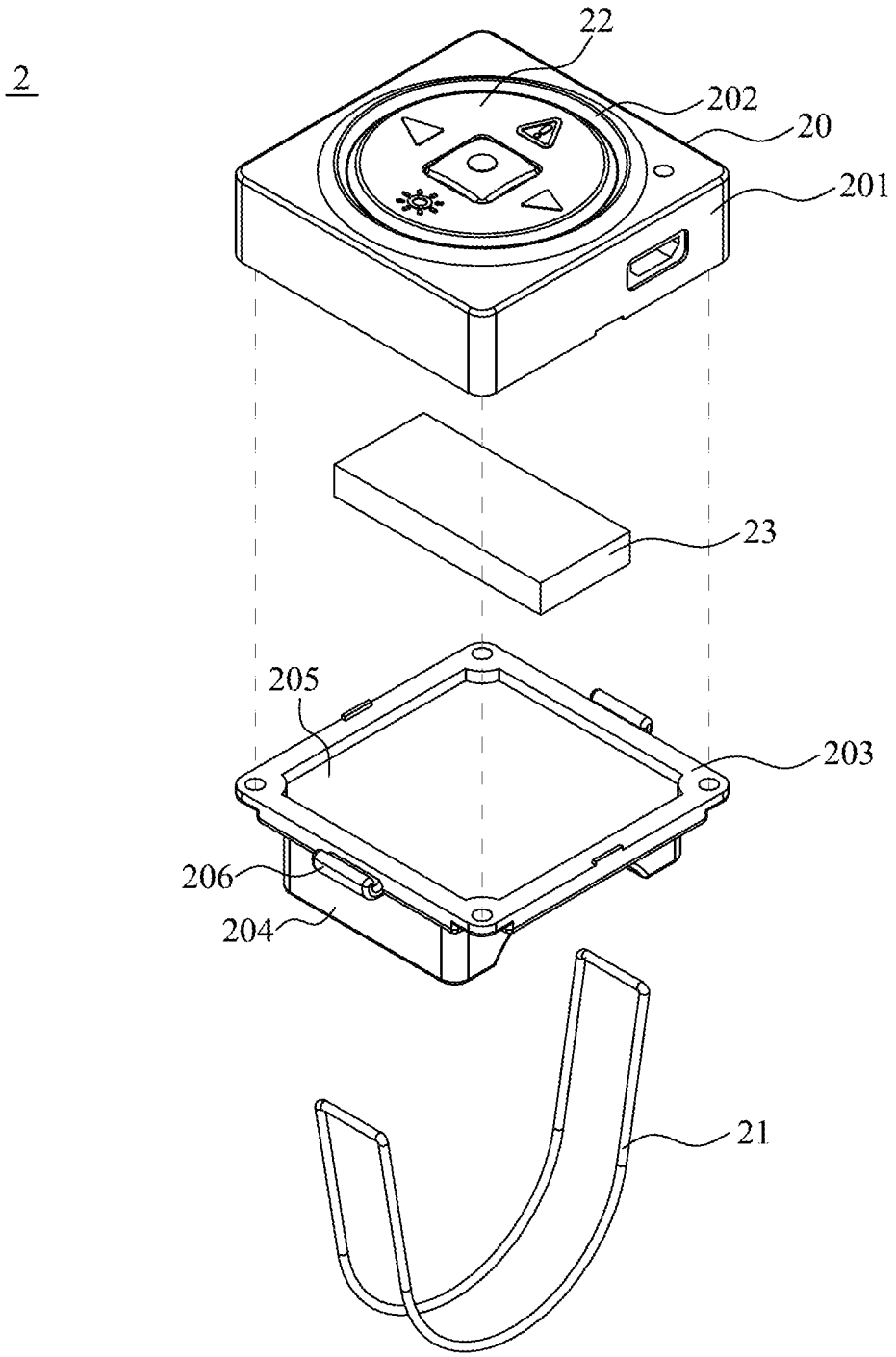
FIG. 9 is an exploded view of the control device of FIG. 2.

Referring to FIG. 9, the control device 2 is provided with an outer housing 20 and a fixed belt 21. The housing 20 has a top cover 201 forming an orifice 202 and a bottom cover 203 assembled with the top cover 201. The orifice 202 of the top cover 201 is provided with an operation interface 22, and the bottom cover 203 is provided with a base 204 forming a depression 205. The base 204 is provided with at least one snap hook 206 on each side. The depression 205 is internally formed with several non-slip ribs (not shown). The fixed belt 21 is designed as a hook ring with a long striped appearance. The two ends of the hook are attached to the two snap hooks 206 of the base 204. The fixed belt 21 and the housing 20 together form an enclosing space to fit the object so that a central section of the fixed belt 21 and the depression 205 of the base 204 are clamped on opposite sides of the object, respectively.

As shown in FIG. 1 and FIG. 9, the housing 20 has an auxiliary printed circuit board 23 and an auxiliary power module 24 inside. The printed circuit board 23 has a wireless transmission module 231 and a micro-processor 232. The wireless transmission module 231 is connected to the wireless receiver module 131 using Bluetooth or Wi-Fi. The micro-processor 232 is electrically connected to the operation interface 22, the wireless transmission module 231, and the auxiliary power module 24.

As shown in FIG. 1, when the operation interface 22 is pressed by a user, a control command 3 will be generated by the operation interface 22. The micro-processor 232 will later obtain the control command 3 and provide the control command 3 to the wireless receiver module 131 via the wireless transmission module 231. The printed circuit board 13 obtains the control command 3 through the wireless receiver module 131 to allow the indicator 11 to produce a projected light source in response to the control command 3.

Figure 10A:
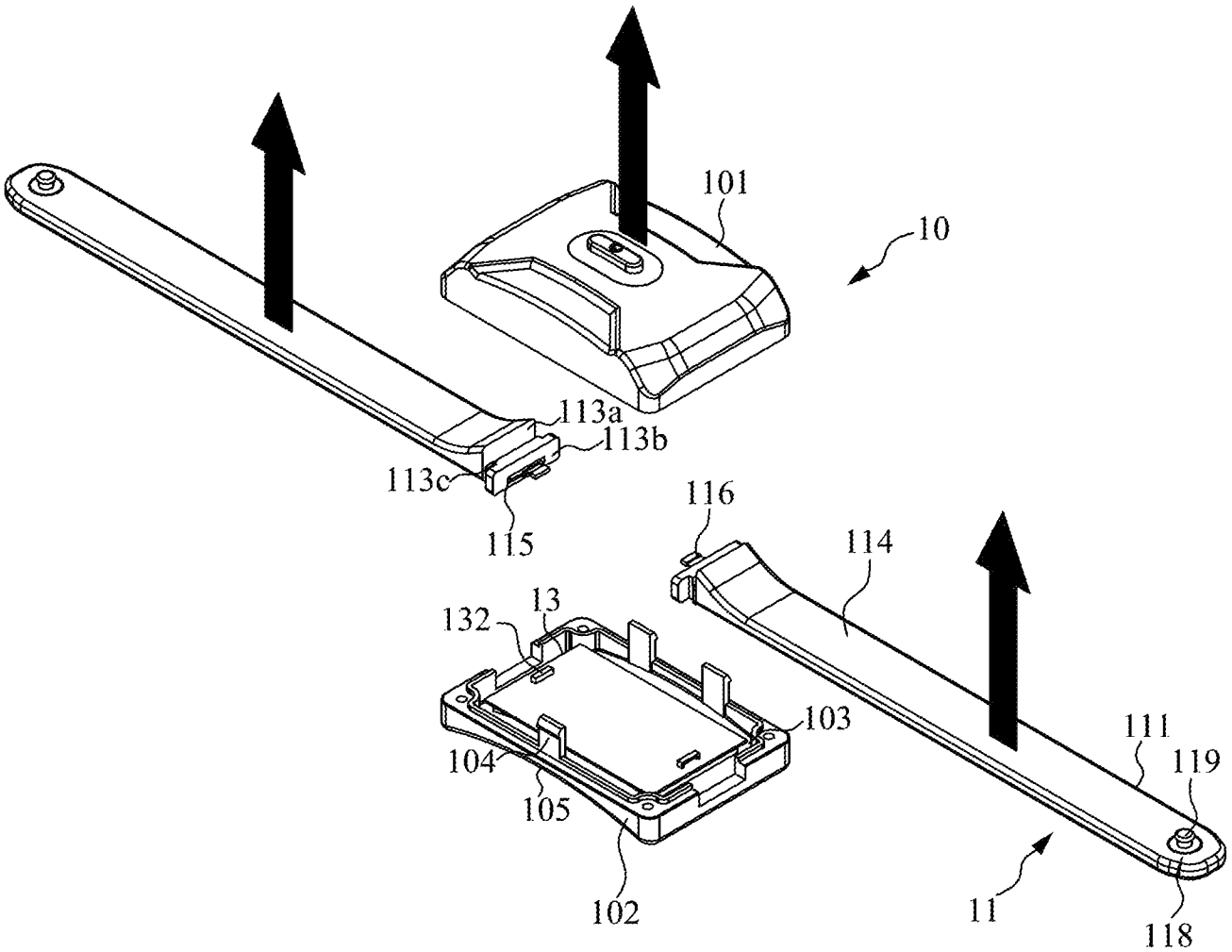
FIG. 10A and FIG. 10B are schematic diagrams illustrating the replacement of the light emitting member of FIG. 10C.
Figure 10B:
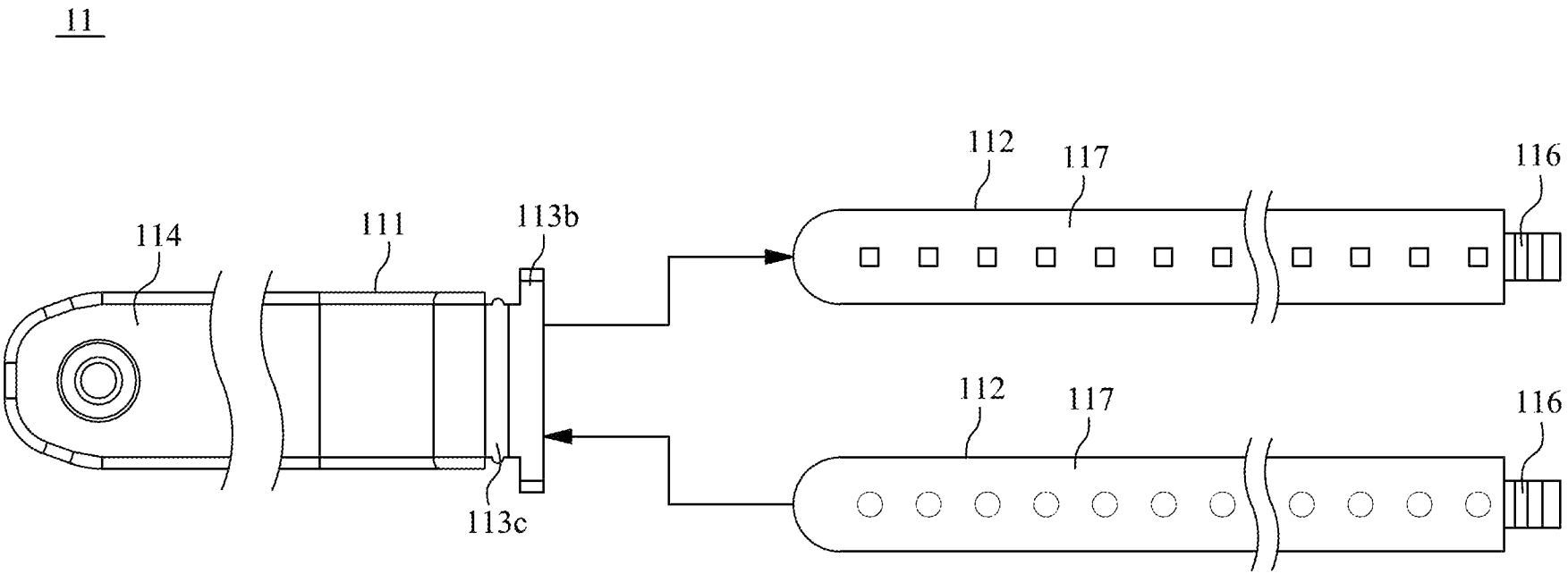
Figure 10C:
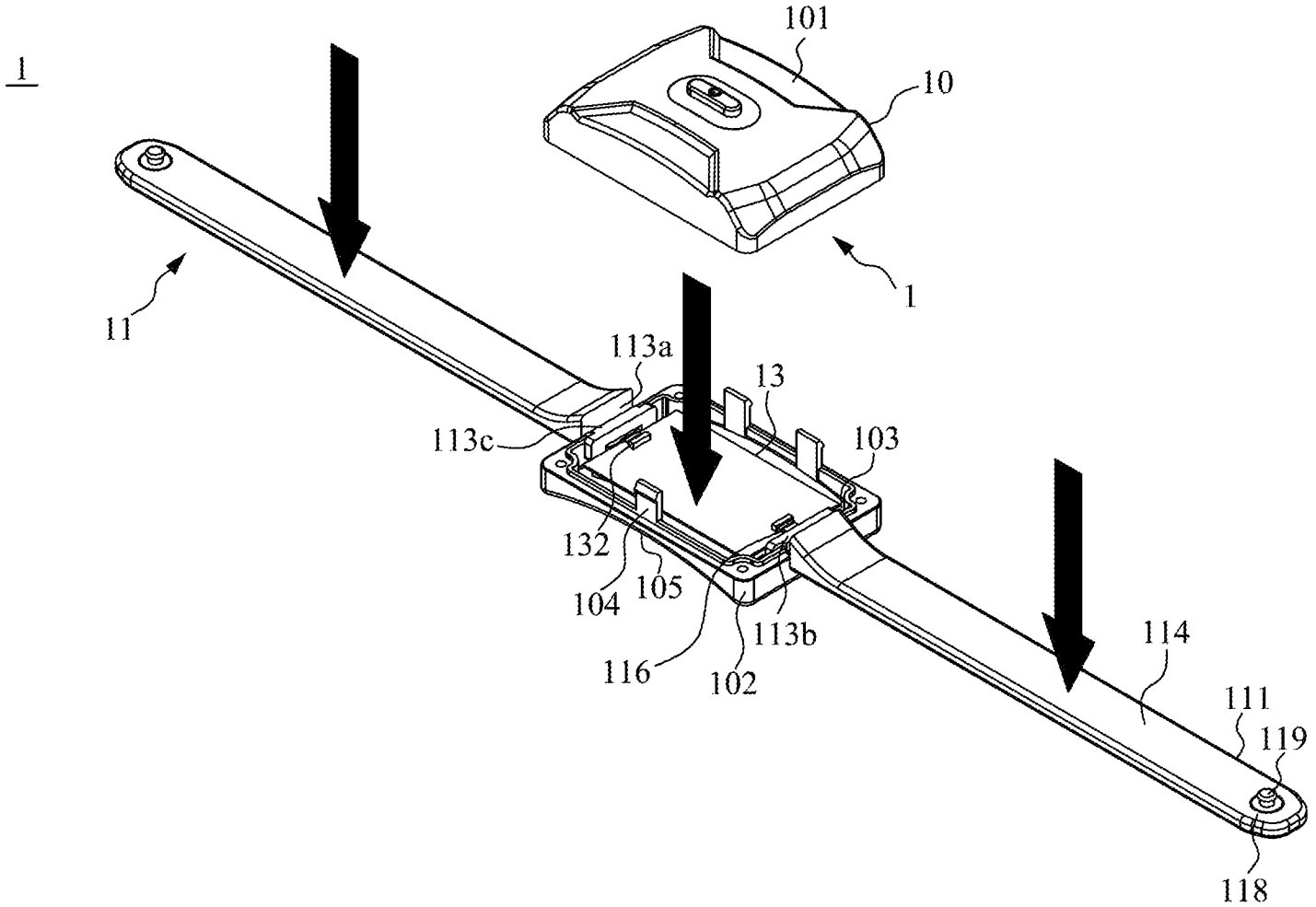

Referring to FIG. 10A to FIG. 10C, when the light emitting member 112 in the indication system is damaged, the user must first separate the upper shell part 101 from the lower shell part 102 and disconnect the indicator 11 from the connector 132 of the printed circuit board 13 before removing the indicator 11 from the groove 103 of the lower shell part 102. Then, the connection part 116 of the light emitting member 112 exposed in the light transmissive member 111 is held, the projection part 117 is removed from the slot 115 of the light transmissive member 111, and the other light emitting member 112 is subsequently inserted into the slot 115. Finally, the indicator 11 will be stuck in the groove 103, and the connection portion 116 will be electrically connected to the connector 132, and then the upper shell part 101 will be assembled to the lower shell part 102, and then the light emitting part 112 will be replaced.

Figure 11:
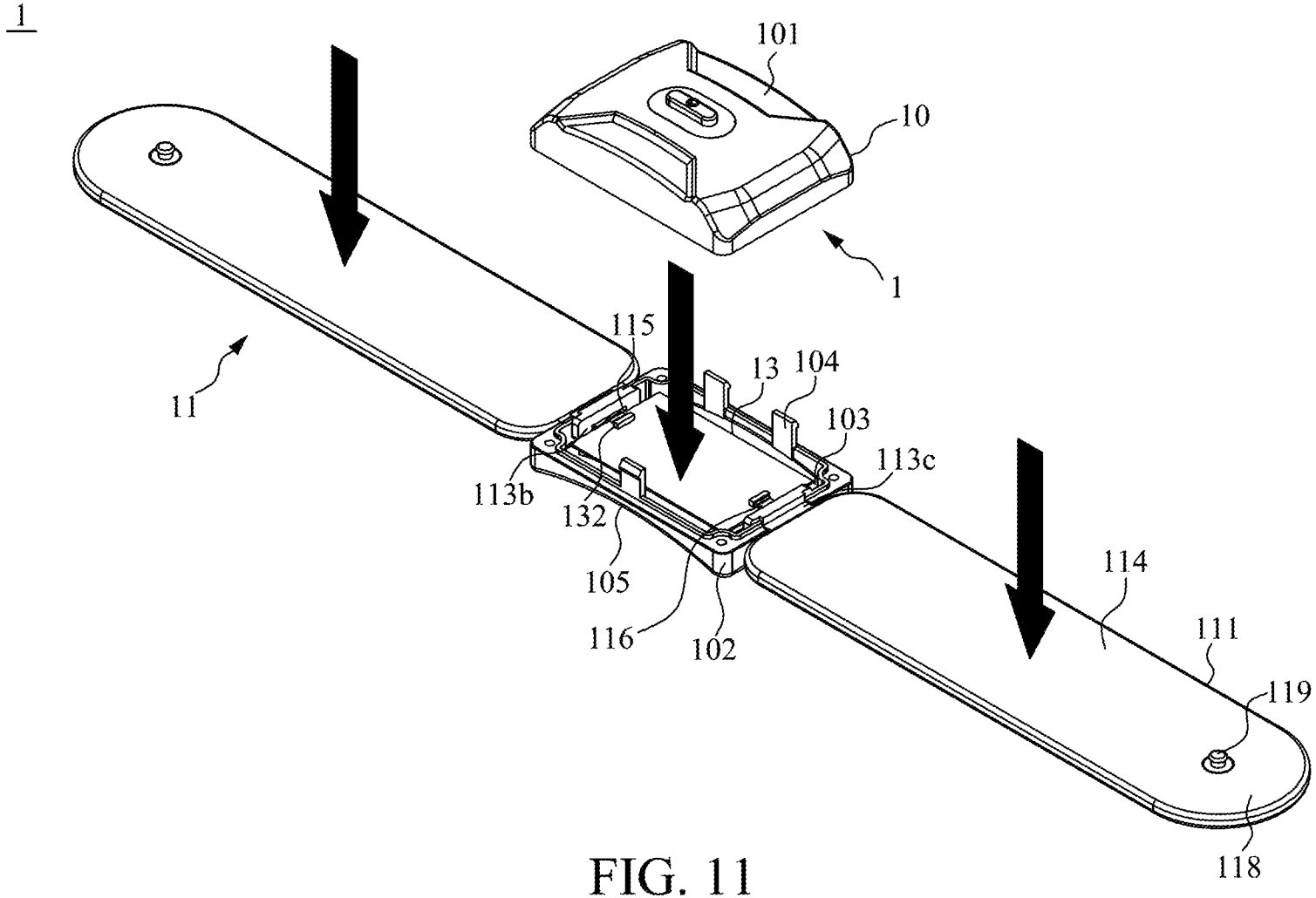
FIG. 11 is a schematic diagram of the replacement of the indicator.

Referring to FIG. 11, to replace the indicator 11 to change the shape, color or light form of the light source, only the indicator 11 is removed from the lower shell part 102 and the indicator 11 is replaced with one of a new shape to fit in the groove 103, without separation of the light emitting member 112 and the light transmissive member 111 from each other.

Figure 12B:
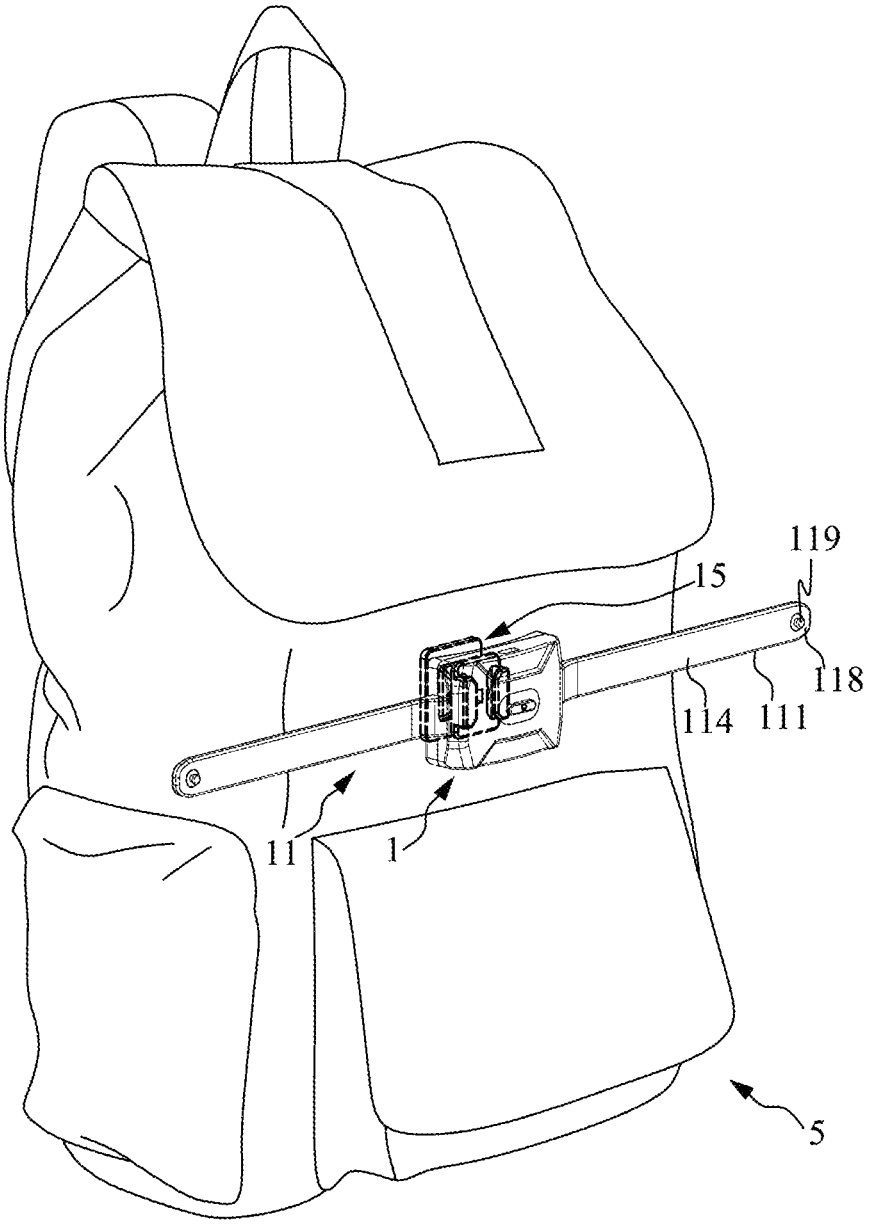
Figure 12C:
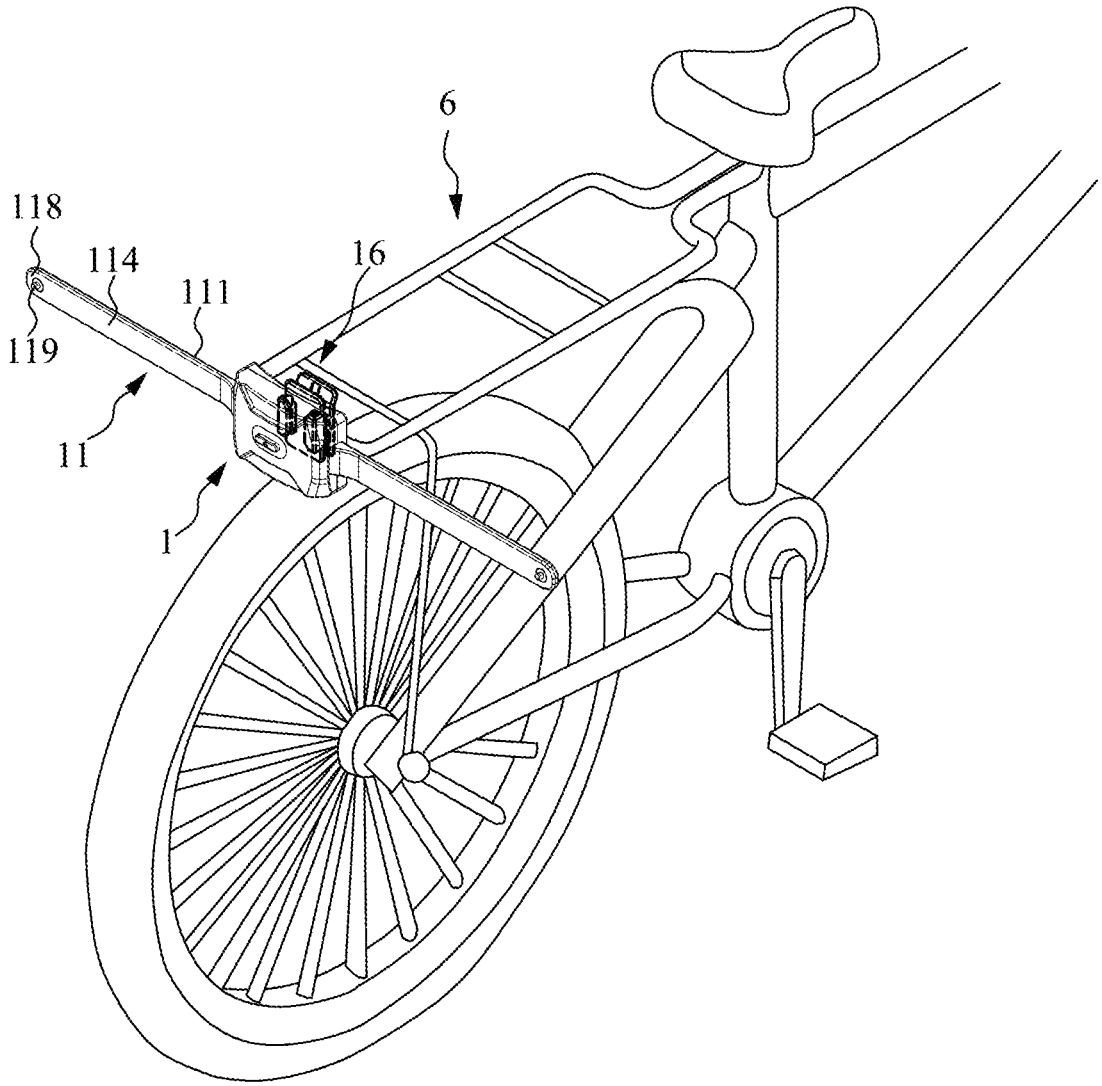

As shown in FIG. 12A, the portable indication system of the present invention may be attached to a general cap 4 or to other items with a rounded profile by means of the positioning belt 17. As shown in FIG. 12B, the portable indication system may also be adjusted by the oscillating bracket 15 adhered to the surface of the backpack 5, vehicle shell, raincoat, helmet or the like for projection angle adjustment. As shown in FIG. 12C, the portable indication system may also be clamped to a frame 6, a clothing pocket or a backpack strap as sheet-like object by the clamping bracket 16.

What is claimed is:

1. A portable indication system, comprising:

an indication device, having a cover and an indicator that is removably attached to the cover, the cover is constructed with an interior and an orifice connecting the interior, and a printed circuit board is provided in the interior, the printed circuit board has a wireless receiver module and a connector at the extension of the orifice; and a control device, being constructed with an operation interface, a wireless transmission module, and a micro-processor, the wireless transmission module is connected to the wireless receiver module, the micro-processor is electrically connected to the operation interface and the wireless transmission module, a control command is generated by the operation interface, and the control command is transmitted from the micro-processor to the printed circuit board via the wireless transmission module and the wireless receiver module, so the indicator generates a projected light source in response to the control command;

wherein the indicator comprises a light transmissive member and a light emitting member assembled inside the light transmissive member, a portion of the length of the light emitting member penetrates into the interior to form a connection portion electrically connected to the connector, and a residual length of the light emitting member forms a projection portion wrapped by the light transmissive member on the outside of the cover.

2. The portable indication system as claimed in claim 1, wherein the light transmissive member has a detachable portion and a wrapping portion, the detachable portion is fixed around the orifice inside the cover and a slot is formed inside both the detachable portion and the wrapping portion, and thereby the light emitting member is inserted into the detachable portion and the wrapping portion in sequence so that the projection portion is covered by the wrapping portion completely.

3. The portable indication system as claimed in claim 2, wherein the indication device further has a positioning belt, the positioning belt has several opening holes, the light transmissive member has a positioning portion that extends from the wrapping portion, and the positioning portion is provided with a positioning pillar that may be inserted into one of the openings and thus the positioning belt, the cover and the indicator form together an accommodation space as a first positioning means.

4. The portable indication system as claimed in claim 3, wherein the locating pillar is composed of a magnetic material, so the light transmissive member can generate a magnetic suction as a secondary locating means.

5. The portable indication system as claimed in claim 2, wherein the detachable portion is constructed with a baffle and a retainer located on opposite sides of the orifice, and a neck that fits the shape of the orifice is provided between the baffle and the retainer, thus the detachable portion that is confined by the orifice cannot move with respect to cover.

6. The portable indication system as claimed in claim 5, wherein the cover is composed of a first shell member and a second shell member that is removably mounted to the first shell member and, after the first shell member is removed from the second shell member, one edge of the orifice will form a hollow section to allow the indicator to be separated from the cover.

7. The portable indication system as claimed in claim 1, wherein the light transmissive member and the light emitting member are constructed of a flexible material that allows the indicator to produce a deformation to match the shape of an object.

8. The portable indication system as claimed in claim 1, wherein the indication device further comprises an oscillating bracket, the oscillating bracket is equipped with an oscillating member and a positioning member, the oscillating member has a wedge track, a shaft, and a baffle connected between the wedge track and the shaft, and the positioning member has two hubs pivotally connected to the shaft and a contact plate fixed to an object.

9. The portable indication system as claimed in claim 1, wherein the indication device further comprises a clamping bracket, the clamping bracket has a wedge track, a clamping arm, and a partition connected between the wedge track and the clamping arm, the wedge track is assembled in a positioning groove formed by the cover, a first end of the clamping arm is connected to the partition and a second end of the clamping arm contacts the partition, and the second end of the clamping arm will generate a resilient recovery force when moving away from the partition.

10. The portable indication system as claimed in claim 1, wherein the control device is provided with a housing for accommodating the operation interface, the wireless transmission module and the micro-processor; and a fixed belt that together with the housing forms an enclosing space.

11. The portable indication system as claimed in claim 10, wherein the housing has a top cover forming an orifice and a bottom cover forming a depression and the bottom cover is provided with at least one snap hook on the two opposite sides of the cover separately, and the fixed belt is connected to the snap hook at each end of the belt, thus a central section of the fixed belt holds an object in conjunction with the depression.

* * * * *